US011572888B2

(12) United States Patent
Yagi et al.

(10) Patent No.: US 11,572,888 B2
(45) Date of Patent: Feb. 7, 2023

(54) IMPELLER OF ROTATING MACHINE AND ROTATING MACHINE

(71) Applicant: MITSUBISHI HEAVY INDUSTRIES COMPRESSOR CORPORATION, Tokyo (JP)

(72) Inventors: Nobuyori Yagi, Tokyo (JP); Noriyuki Okada, Tokyo (JP); Chihiro Myoren, Tokyo (JP); Akihiro Nakaniwa, Tokyo (JP); Shuichi Yamashita, Tokyo (JP); Jo Masutani, Tokyo (JP); Hirofumi Higuchi, Hiroshima (JP); Takashi Oda, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 17/497,407

(22) Filed: Oct. 8, 2021

(65) Prior Publication Data

US 2022/0145898 A1 May 12, 2022

(30) Foreign Application Priority Data

Nov. 12, 2020 (JP) ..... JP2020-188402

(51) Int. Cl.
*F04D 29/28* (2006.01)
*F04D 17/12* (2006.01)

(52) U.S. Cl.
CPC ..... *F04D 29/286* (2013.01); *F04D 17/122* (2013.01); *F05D 2240/301* (2013.01); *F05D 2240/303* (2013.01); *F05D 2240/304* (2013.01)

(58) Field of Classification Search
CPC ..... F05D 2240/301
See application file for complete search history.

(56) References Cited

U.S. PATENT DOCUMENTS 5,685,696 A 11/1997 Zangeneh et al.
8,308,420 B2 * 11/2012 Yagi ..... F04D 29/30 415/1

(Continued)

FOREIGN PATENT DOCUMENTS

CN 101865145 B 9/2012
DE 4220227 A1 12/1993

(Continued)

OTHER PUBLICATIONS

The extended European Search Report issued in corresponding European Application No. 21206286.3, dated Apr. 4, 2022 (9 pages).

*Primary Examiner* — Sabbir Hasan
(74) *Attorney, Agent, or Firm* — Osha Bergman Watanabe & Burton LLP

(57) ABSTRACT

The impeller of a rotating machine according to at least one embodiment of the present discloser is provided with: a disc; a cover disposed on an opposite side of a radial passage from the disc in an axial direction; and a blade disposed between the disc and the cover. In a dimensionless position along a camber line of the blade when the position of a leading edge of the blade is defined as 0 and the position of a trailing edge of the blade is defined as 1, a position where an angle difference between a first blade angle at a disc-side end portion of the blade and a second blade angle at a cover-side end portion of the blade is maximum is in a range of 0.5 or more and 1 or less. The first blade angle is −10 degrees or more and 0 degrees or less at the position where the angle difference is maximum.

13 Claims, 6 Drawing Sheets

(56) References Cited

U.S. PATENT DOCUMENTS

| | | | | |
|---|---|---|---|---|
| 10,221,854 | B2 * | 3/2019 | Yamashita | F04D 17/122 |
| 10,634,157 | B2 * | 4/2020 | Rubino | F04D 17/122 |
| 2009/0035122 | A1 | 2/2009 | Yagi et al. | |
| 2015/0017009 | A1 | 1/2015 | Okuda | |
| 2016/0238019 | A1 | 8/2016 | Kobayashi et al. | |
| 2018/0058468 | A1 | 3/2018 | Yanagisawa et al. | |

FOREIGN PATENT DOCUMENTS

| | | | |
|---|---|---|---|
| JP | 2011-122516 | A | 6/2011 |
| JP | 5351941 | B2 | 11/2013 |
| JP | 5670517 | B2 | 2/2015 |
| JP | 6620440 | B2 | 12/2019 |
| JP | 6627175 | B2 | 1/2020 |
| WO | 2015/0104282 | A1 | 7/2015 |

* cited by examiner

IMPELLER OF ROTATING MACHINE AND ROTATING MACHINE

TECHNICAL FIELD

The present disclosure relates to an impeller of a rotating machine and a rotating machine.

BACKGROUND

As a rotating machine used in an industrial compressor, a turbo chiller, or a small gas turbine, a machine including an impeller with pluralities of blades mounted on a disc fixed to a rotational shaft is known. This rotating machine provides pressure energy and velocity energy to a gas by rotating the impellers.

For example, Patent Document 1 discloses a centrifugal compressor including an impeller. The impeller is a so-called closed impeller composed of a disc, a plurality of blades on the disc, and a cover that covers the plurality of blades.

CITATION LIST

Patent Literature

Patent Document 1: JP2011-122516A

SUMMARY

Rotating machines such as a compressor are required to have larger capacity and smaller dimension. As a method for responding to such requirements, for example, increasing the peripheral speed of the impeller may be mentioned.

However, simply increasing the rotational speed of the impeller increases centrifugal force acting on the impeller. Increasing the wall thickness of the inner peripheral portion of the cover to prepare for increased centrifugal force increases the stiffness of the inner peripheral portion of the cover, but also increases the weight, making it more susceptible to centrifugal force.

In view of the above circumstances, an object of at least one embodiment of the present disclosure is to provide an impeller and a rotating machine that can reduce the influence of centrifugal force acting on the cover.

(1) An impeller of a rotating machine according to at least one embodiment of the present disclosure comprises: a disc; a cover disposed on an opposite side of a radial passage from the disc in an axial direction; and a blade disposed between the disc and the cover. In a dimensionless position along a camber line of the blade when the position of a leading edge of the blade is defined as 0 and the position of a trailing edge of the blade is defined as 1, a position where an angle difference between a first blade angle at a disc-side end portion of the blade and a second blade angle at a cover-side end portion of the blade is maximum is in a range of 0.5 or more and 1 or less. The first blade angle is −10 degrees or more and 0 degrees or less at the position where the angle difference is maximum.

(2) A rotating machine according to at least one embodiment of the present disclosure comprises the impeller having the above configuration (1).

According to at least one embodiment of the present disclosure, it is possible to reduce the influence of centrifugal force acting on the cover while increasing the stiffness.

DETAILED DESCRIPTION

Embodiments of the present disclosure will now be described in detail with reference to the accompanying drawings. It is intended, however, that unless particularly identified, dimensions, materials, shapes, relative positions, and the like of components described in the embodiments shall be interpreted as illustrative only and not intended to limit the scope of the present disclosure.

For instance, an expression of relative or absolute arrangement such as "in a direction", "along a direction", "parallel", "orthogonal", "centered", "concentric" and "coaxial" shall not be construed as indicating only the arrangement in a strict literal sense, hut also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

(Overall Configuration of Centrifugal Compressor 1)

Hereinafter, a multi-stage centrifugal compressor including multiple stages of impellers arranged in the axial direction will be described as an example of the rotating machine.

Figure 1:
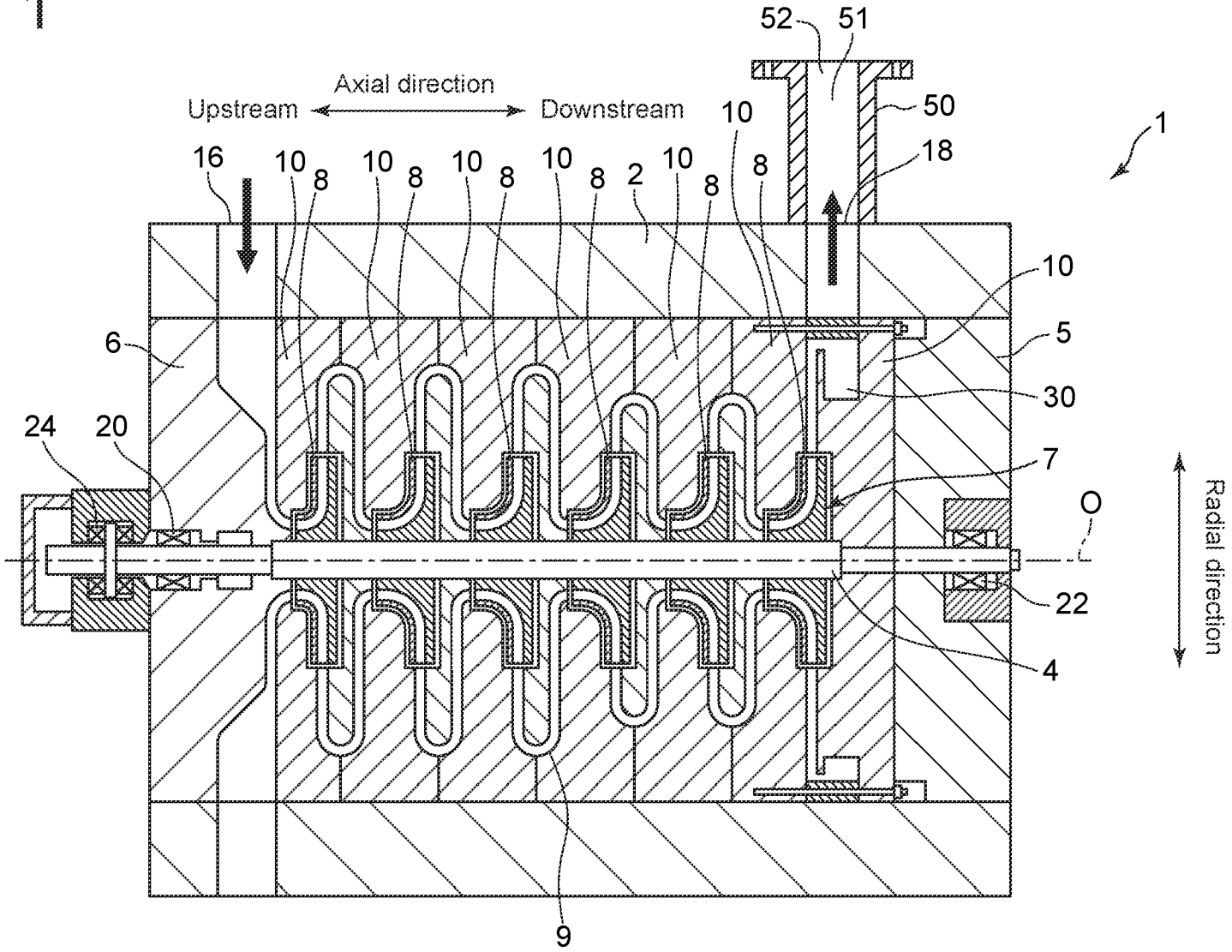
FIG 1. is a cross-sectional view of a centrifugal compressor according to some embodiments, taken along the axial direction of a rotational shaft.

FIG. 1 is a cross-sectional view of a centrifugal compressor according to some embodiments, taken along the axial direction of a rotational shaft.

As shown in FIG. 1, the centrifugal compressor 1 includes a casing 2 and a rotor 7 rotatably supported within the casing 2. The rotor 7 includes a rotational shaft (shaft) 4 and multi-stage impellers 8 fixed to an outer surface of the rotational shaft 4.

The casing 2 accommodates a plurality of diaphragms 10 arranged in the axial direction. The diaphragms 10 are disposed so as to surround the impeller 8 from the radially outer side. Additionally, casing heads 5, 6 are disposed on both sides of the diaphragms 10 in the axial direction.

The rotor 7 is rotatably supported by radial bearings 20, 22 and a thrust bearing 24 so as to rotate around the axis O.

One end of the casing 2 has an intake port 16 through which a fluid enters from the outside, and the other end of the casing 2 has a discharge port 18 through which a fluid compressed by the centrifugal compressor 1 is discharged to the outside. Inside the casing 2, a flow passage 9 is formed so as to connect the multi-stage impellers 8. The intake port 16 communicates with the discharge port 18 via the impellers 8 and the flow passage 9. The discharge port 18 is connected to a discharge pipe 50.

A fluid which enters the centrifugal compressor 1 thorough the intake port 16 flows from upstream to downstream thorough the multi-stage impellers 8 and the flow passage 9. The fluid is compressed stepwise by centrifugal force of the impellers 8 when passing through the multi-stage impellers 8. The compressed fluid having passed through the most downstream impeller 8 of the multi-stage impellers 8 is guided to the outside through the scroll passage 30 and the discharge port 18, and is discharged from an outlet portion 52 of a discharge passage 51 through the discharge pipe 50.

In the following description, along the axial direction of the centrifugal compressor 1, i.e., along the axis O of the rotational shaft 4, the intake port 16 side is referred to as the axially upstream side or simply the upstream side, and the discharge port 18 side is referred to as the axially downstream side or simply the downstream side.

(Impeller 8)

Figure 2:
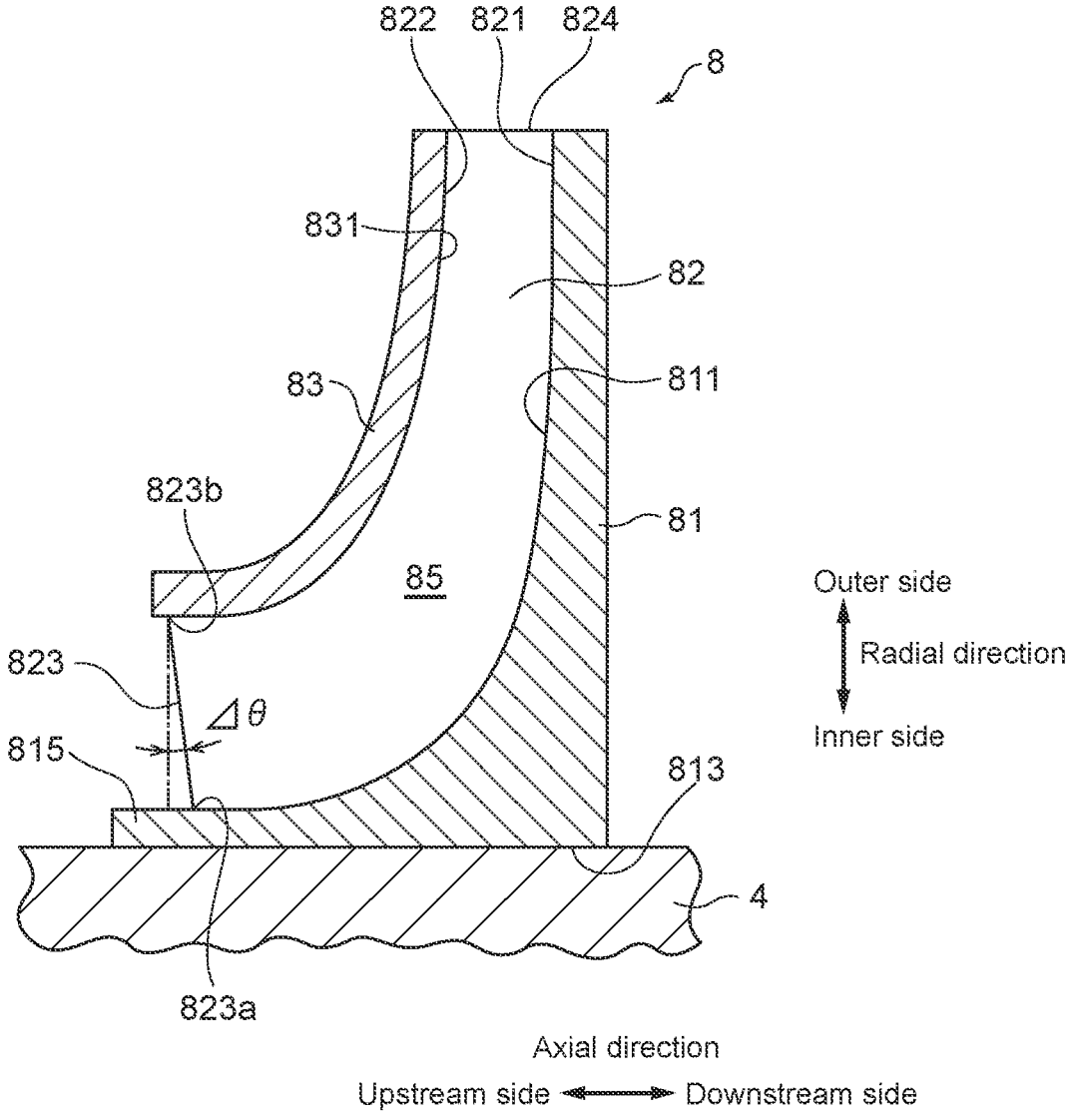
FIG. 2 is a schematic cross-sectional view of the impeller according to some embodiments, taken along the axial direction.

FIG. 2 is a schematic cross-sectional view of the impeller according to some embodiments, taken along the axial direction.

As shown in FIG. 1, the impeller 8 according to some embodiments includes a substantially disc-shaped disc 81 that gradually expands in diameter from the axially upstream side to the axially downstream side, and a plurality of blades 82 radially mounted on the disc 81 and arranged in the circumferential direction so as to rise from a hub surface (disc main surface) 811 of the disc 81 to one side of the axis O of the rotational shaft 4. The impeller 8 according to some embodiments has a cover 83 mounted so as to cover the plurality of blades 82 from the axially upstream side. A surface of the cover facing the hub surface 811 of the disc 81 is referred to as a facing surface 831.

The impeller 8 according to some embodiments has a gap between the cover 83 and the diaphragm 10 to prevent contact between the impeller 8 and the diaphragm 10.

For convenience of explanation, with respect to the impeller 8, the axially upstream side of the centrifugal compressor 1 is also referred to as the cover side, and the axially downstream side is also referred to as the disc side.

The impeller 8 according to some embodiments has a radial passage 85 which is a space defined such that a fluid flows therethrough in the radial direction. The radial passage 85 is defined by two surfaces (pressure surface and suction surface) of a pair of blades 82 adjacent to each other, and surfaces of the disc 81 and cover 83 (hub surface 811 and facing surface 831) disposed on both sides of the blades 82 in the axis O direction. The radial passage 85 takes in and discharges a fluid as the blades 82 rotate with the disc 81. Specifically, the radial passage 85 takes in the fluid using the axially upstream side of the blades 82, i.e., the radially inner side as the inlet for fluid, and the radial passage 85 guides and discharges the fluid using the radially outer side as the outlet for fluid.

That is, the impeller 8 according to some embodiments includes a disc 81, a cover 83 disposed on the opposite side of the radial passage 85 from the disc 81 in the axial direction, and a blade 82 disposed between the disc 81 and the cover 83.

In the impeller 8 according to some embodiments, the disc 81 has a small diameter on the end surface facing upstream in the axial direction and a large diameter on the end surface facing downstream in the axial direction. Further, the disc 81 gradually expands in diameter from the axially upstream end surface to the axially downstream end surface. In other words, the disc 81 has a substantially disc shape in the axis O direction and a substantially umbrella shape as a whole.

In the impeller 8 according to some embodiments, a through hole 813 is formed in the radially inner portion of the disc 81 to penetrate the disc 81 in the axis O direction. By inserting and fitting the rotational shaft 4 into the through hole 813, the impeller 8 is fixed to the rotational shaft 4 so as to be rotatable with the rotational shaft 4.

In the impeller 8 according to some embodiments, the cover 83 is a member integrally provided with the plurality of blades 82 so as to cover the blades 82 from the axially upstream side. The cover 83 has a substantially umbrella shape that gradually expands in diameter from the axially upstream side to the axially downstream side. That is, the impeller 8 according to some embodiments is a so-called closed impeller with the cover 83.

Figure 3:
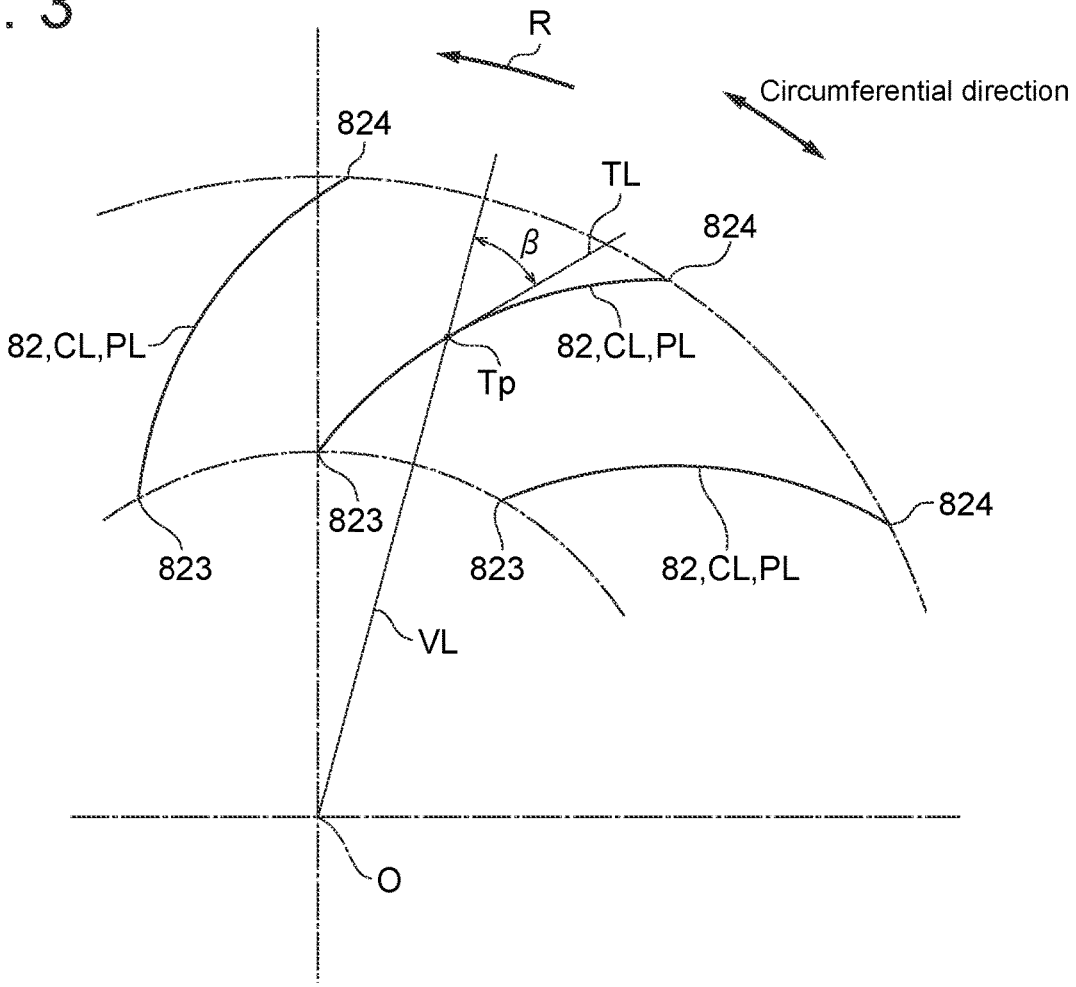
FIG. 3 is a schematic diagram for describing blade angle of the blade of the impeller according to some embodiments.

FIG. 3 is a schematic diagram for describing blade angle of the blade of the impeller according to some embodiments when the impeller according to some embodiments is viewed from the axially upstream side, without depicting the cover. In FIG. 3, the shape and position of the blades 82 are schematically represented by describing the camber line CL, which will be described later.

In the impeller 8 according to some embodiments, the blades 82 are arranged at regular intervals in the circumferential direction around the axis O, i.e., in the rotational direction R of the impeller 8, so that the blades 82 rise from the disc 81 toward the cover 83 upstream in the axial direction with the axis O at the center. Here, for example as shown in FIG. 2, the root end portion of the blade 82 adjacent to the disc 81 and connected to the disc 81 is referred to as a disc-side end portion 821, and the tip end portion of the blade 82 adjacent to the cover 83 is referred to as a cover-side end portion 822. In the impeller 8 according to some embodiments, the blade 82 is curved into different shapes at the disc-side end portion 821 and the cover-side end portion 822. Specifically, each blade 82 is formed so as to three-dimensionally curve backward in the rotational direction R from the radially inner side to the radially outer side of the disc 81. More specifically, the blade 82 is formed such that the blade angle β of the disc-side end portion 821 and the blade angle β of the cover-side end portion 822 have different angular distributions. Accordingly, the contour of the disc-side end portion 821 from the leading edge 823 to the trailing edge 824 of the blade 82 is different from the contour of the cover-side end portion 822 from the leading edge 823 to the trailing edge 824.

(Blade Angle β)

With respect to the impeller 8 according to some embodiments, the blade angle β is defined as follows.

The blade angle β is an angle that determines the curved surface shape of the blade 82 from the leading edge 823 to the trailing edge 824 of the blade 82. Specifically, as shown in FIG. 3, the blade angle β is derived by drawing a projected curve PL by projecting the center curve (camber line) CL, which is a virtual curve drawn by connecting the middle of the thickness direction of the blade 82, onto the disc 81 from one side in the axis O direction. Among angles formed by the tangent line TL to the projected curve PL and the virtual line VL connecting the axis O to the tangent point Tp between the projected curve PL and the tangent line TL, the angle formed backward of the virtual line VL in the rotational direction R of the disc 81 (upstream side in the rotational direction) on the radially outer side of the tangent point Tp is defined as the blade angle β.

With respect to the impeller 8 according to some embodiments, the blade angle β shall be negative when the tangent line TL to the projected curve PL is located, on the radially outer side of the tangent point Tp, backward of the virtual line VL in the rotational direction R of the disc 81.

With respect to the impeller 8 according to some embodiments, the blade angle β at the disc-side end portion 821 is defined as the first blade angle β1, and the blade angle β at the cover-side end portion 822 is defined as the second blade angle β2.

Figure 4A:
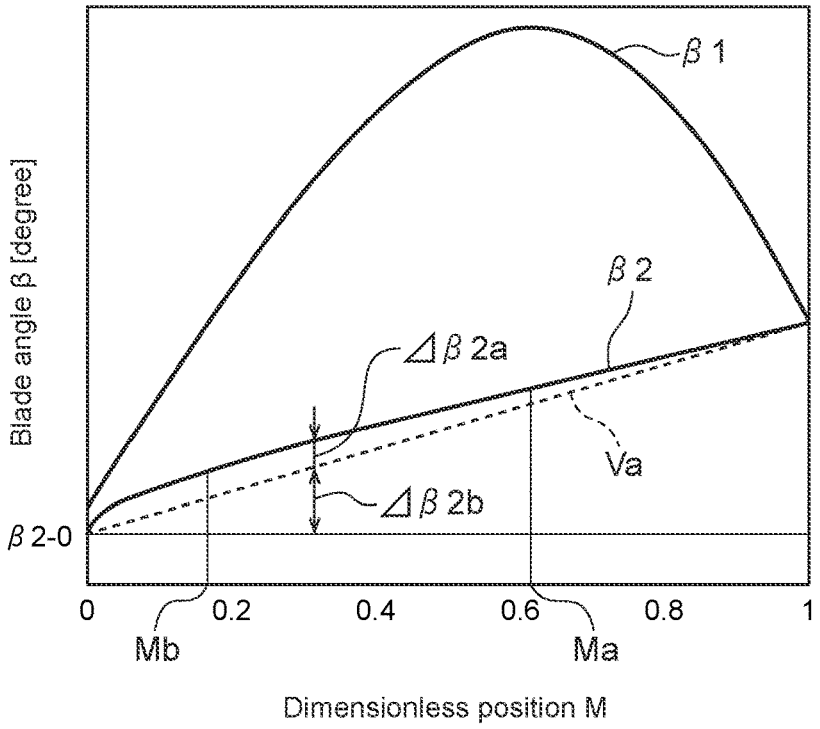
FIG. 4A is an example of a graph showing a distribution of the first blade angle and the second blade angle in the impeller according to some embodiments.

FIG. 4A is an example of a graph showing a distribution of the first blade angle β1 and the second blade angle β2 in the impeller 8 according to some embodiments.

Figure 4B:
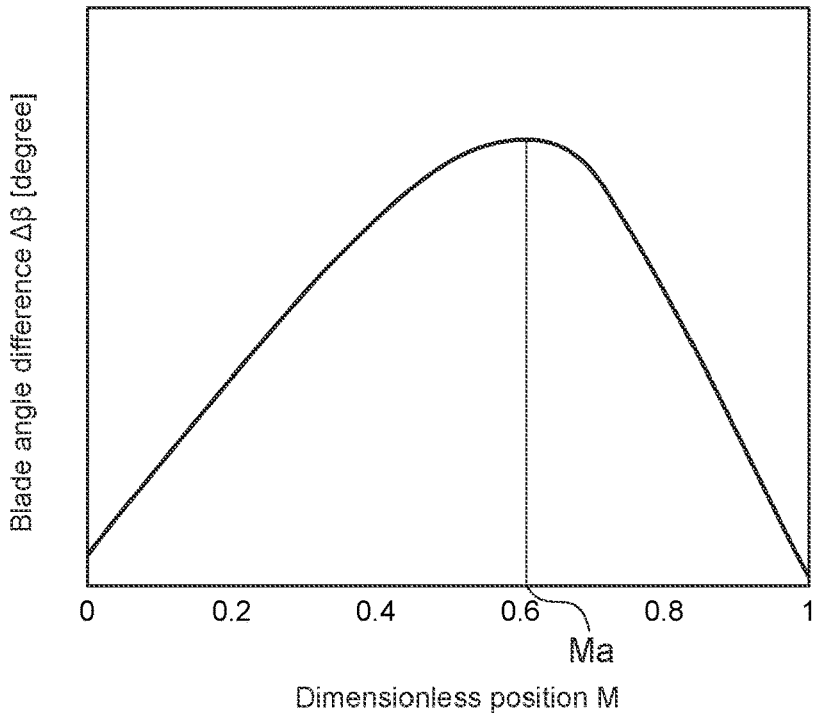
FIG. 4B is an example of a graph showing a distribution of an angle difference between the first blade angle and the second blade angle in the impeller according to some embodiments.

FIG. 4B is an example of a graph showing a distribution of an angle difference (blade angle difference Δβ) between the first blade angle β1 and the second blade angle β2 in the impeller 8 according to some embodiments.

The blade angle difference Δβ shown in FIG. 4B is a value obtained by subtracting the value of the second blade angle β2 from the value of the first blade angle β1 (β1-β2).

The horizontal axis of the graphs in FIGS. 4A and 4B is the dimensionless position M along the camber line CL of the blade 82 when the position of the leading edge 823 of the blade 82 is defined as 0 and the position of the trailing edge 824 of the blade 82 is defined as 1.

In the impeller 8 according to some embodiments, at least in the vicinity of the maximum blade angle difference position Ma, which is the dimensionless position M where the blade angle difference Δβ is maximum, the first blade angle μ1 is greater than the second blade angle β2.

Rotating machines such as the centrifugal compressor 1 are required to have larger capacity and smaller dimension. As a method for responding to such requirements, for example, increasing the peripheral speed of the impeller 8 may be mentioned.

However, simply increasing the rotational speed of the impeller 8 increases centrifugal force acting on the cover 83 of the impeller 8, resulting in deformation of the cover 83. As the cover 83 deforms due to centrifugal force, the circumferential stress acts on the cover 83, making the strength of the cover 83 a problem.

Here, the centrifugal force acting on the cover 83 increases with distance in the radial direction. Therefore, suppressing deformation in the radially outer region of the cover 83 is particularly effective in suppressing the circumferential stress acting on the cover 83.

In the impeller 8 according to some embodiments, the cover 83 is connected to the disc 81 via the blade 82 as described above. Accordingly, when the cover 83 deforms due to centrifugal force, the blade 82 also deforms. Therefore, if the deformation of the blade 82 can be suppressed, the deformation of the cover 83 can also be suppressed, and the circumferential stress of the cover 83 can be reduced.

In view of this, in the impeller 8 according to some embodiments, the first blade angle β1 and the second blade angle β2 are set such that the dimensionless position M where the blade angle difference Δβ, which is an angle difference between the first blade angle β1 and the second blade angle β2, is maximum is in the range of 0.5 or more and 1 or less. Further, the first blade angle β1 is set such that the first blade angle β1 is −10 degrees or more and 0 degrees or less at the maximum blade angle difference position Ma where the blade angle difference Δβ is maximum.

With the impeller 8 according to some embodiments, as the absolute value of the blade angle difference Δβ increases, the blade 82 deforms in the thickness direction of the blade 82 so as to be twisted from a flat shape, and the three-dimensional shape becomes more complex, so that the stiffness of the blade 82 can be increased without increasing the thickness of the blade 82. As a result, it is possible to suppress the cover 83 from deforming due to centrifugal force while suppressing the increase in weight of the blade 82.

In the impeller 8 according to some embodiments, since the maximum blade angle difference position Ma is in the range of 0.5 or more and 1 or less, the stiffness of the blade 82 in the radially outer region can be increased. Thus, it is possible to effectively suppress the cover 83 from deforming due to centrifugal force which tends to increase on the radially outer side.

The closer the first blade angle β1 is to 0 degrees, the closer the extension direction of the blade 82 from the leading edge 823 to the trailing edge 824 is to the radial direction, and the greater the stiffness near the root of the blade 82, i.e., near the disc-side end portion 821, against bending of the blade 82 by the centrifugal force received from the cover 83. For this reason, the impeller 8 according to sonic embodiments is configured such that the first blade angle β1 is −10 degrees or more at the maximum blade angle difference position Ma. As a result, it is possible to effectively suppress the cover 83 from deforming due to centrifugal force which tends to increase on the radially outer side.

Further, when the first blade angle β1 is −10 degrees or more at the maximum blade angle difference position Ma, compared to a conventional impeller, the blade angle difference Δβ can be increased, and the stiffness of the blade 82 can be increased without increasing the thickness of the blade 82.

If one intends to simply increase the blade angle difference Δβ, by setting the first blade angle β1 to a positive value, the blade angle difference Δβ can be increased. However, in the impeller 8 according to some embodiments, an upper limit (0 degrees) is set for the first blade angle β1 from the viewpoint of maintaining the performance of the impeller 8.

With the impeller 8 according to some embodiments, since the deformation of the cover 83 due to centrifugal force can be effectively suppressed, it is possible to suppress the circumferential stress acting on the cover 83 in response to deformation of the cover 83 due to centrifugal force. As a result, it is possible to contribute to a higher peripheral speed of the impeller 8 and contribute to a larger capacity and a smaller dimension of the centrifugal compressor 1.

In the impeller 8 according to some embodiments, for example as shown in FIG. 4B, since the blade angle difference Δβ varies with the dimensionless position M, when the blade 82 deforms with the deformation of the cover 83 due to centrifugal force, the deformation state of the blade 82 is not uniform along the dimensionless position M, which makes it difficult for the blade 82 to deform, thus increasing the stiffness of the blade 82.

In FIG. 4A, the thin dashed line represents an assumed angle Va when change in the second blade angle β2 over change in the dimensionless position M is assumed to be constant from the leading edge 823 (i.e., the position where the dimensionless position M is 0) to the trailing edge 824 (i.e., the position where the dimensionless position M is 1).

In the impeller 8 according to some embodiments, the dimensionless position Mb where a difference Δβ2*a* between the second blade angle β2 and the assumed angle Va is maximum is in a range where the dimensionless position M is less than 0.5.

For example, as shown in FIG. 4A, when the graph line of the second wing angle β2 has a shape that is convex upward, it is easy to increase the blade angle difference Δβ as the dimensionless position Mb, where the difference Δβ2*a* between the second blade angle β2 and the assumed angle Va is maximum, moves away from the maximum blade angle difference position Ma.

Therefore, compared to the case where the dimensionless position Mb, where the difference Δβ2*a* between the second blade angle β2 and the assumed angle Va is maximum, is in the range of 0.5 or more, it is easier to increase the blade angle difference Δβ and increase the stiffness of the blade 82.

In the impeller 8 according to some embodiments, the second blade angle β2 is greater than the assumed angle Va at least at the dimensionless position Mb where the difference between the second blade angle β2 and the assumed angle Va is maximum.

In FIG. 4A, a value (Δβ2*a*/Δβ2*b*) obtained by dividing the difference Δβ2*a* between the second blade angle β2 and the assumed angle Va by a difference Δβ2*b* between the second blade angle β2-0 at the leading edge 823 (i.e., position where the dimensionless position M is 0) and the assumed angle Va may be 0.15 or less at the maximum blade angle difference position Ma.

In the impeller 8 according to some embodiments, the assumed angle Va, is greater than the second blade angle β2-0 at the position where the dimensionless position M is 0, and the second blade angle β2 is greater than the assumed angle Va at least at the dimensionless position Mb where the difference between the second blade angle β2 and the assumed angle Va is maximum.

As a result, the blade angle difference Δβ can be increased, and the stiffness of the blade 82 can be increased.

In the impeller 8 according to some embodiments, the second blade angle β2 may monotonically increase as the dimensionless position M approaches the trailing edge 824 (i.e., position where the dimensionless position M is 1), on the trailing edge 824 side of the maximum blade angle difference position Ma.

With this configuration, since the second blade angle β2 at the maximum blade angle difference position Ma is smaller than the second blade angle β2 at the trailing edge 824 (i.e., position where the dimensionless position M is 1), it is easier to increase the blade angle difference Δβ at the maximum blade angle difference position Ma and increase the stiffness of the blade 82.

In the impeller 8 according to some embodiments, the first blade angle β1 may monotonically decrease as the dimensionless position M approaches the trailing edge 824 (i.e., position where the dimensionless position M is 1), on the trailing edge 824 side of the maximum blade angle difference position Ma.

With this configuration, since the first blade angle β1 at the maximum blade angle difference position Ma is greater than the first blade angle β1 at the trailing edge 824 (i.e., position where the dimensionless position M is 1), it is easier to increase the blade angle difference Δβ at the maximum blade angle difference position Ma and increase the stiffness of the blade 82.

In the impeller 8 according to some embodiments, the first blade angle β1 may gradually increase from a value less than −30 degrees as the dimensionless position M approaches the trailing edge 824, on the leading edge 823 side of the maximum blade angle difference position Ma.

With this configuration, on the leading edge 823 side of the maximum blade angle difference position Ma, the first blade angle β1 can be made closer to the first blade angle β1 in a conventional impeller as it approaches the leading edge 823 (i.e., position where the dimensionless position M is 0). As a result, it is possible to contribute to maintaining the performance of the impeller 8.

In the impeller 8 according to some embodiments, the blade angle difference Δβ may gradually increase from a value less than 30 degrees as the dimensionless position M approaches the trailing edge 824 in a range on the leading edge 823 side of the maximum blade angle difference position Ma, and the blade angle difference Δβ may gradually decrease to a value less than 30 degrees as the dimensionless position M approaches the trailing edge 824 in a range on the trailing edge 824 side of the maximum blade angle difference position Ma.

With this configuration, on the trailing edge 824 side of the maximum blade angle difference position Ma, the first blade angle β1 can be made closer to the first blade angle β1 in a conventional impeller as it approaches the trailing edge 824. As a result, it is possible to contribute to maintaining the performance of the impeller 8.

In the impeller 8 according to some embodiments, the first blade angle β1 may include, in a range where the dimensionless position M is 0 or more and less than 0.4, a range where the first blade angle gradually increases as the dimensionless position M approaches the trailing edge 824 and the first blade angle is −50 degrees or more and −30 degrees or less. In other words, in at least part of the range where the dimensionless position M is 0 or more and less than 0.4, the first blade angle β1 may have an angular distribution in which the angle gradually increases as the dimensionless position M approaches the trailing edge 824 from an angle of −50 degrees or more and −30 degrees or less to a greater angle less than −30 degrees.

The first blade angle β1 may include, in a range where the dimensionless position M is 0.4 or more and 0.7 or less, a range where the first blade angle gradually increases as the dimensionless position M approaches the trailing edge 824 and the first blade angle is −30 degrees or more and 0 degrees or less. In other words, in at least part of the range where the dimensionless position M is 0.4 or more and 0.7 or less, the first blade angle β1 may have an angular distribution in which the angle gradually increases as the dimensionless position M approaches the trailing edge 824 from an angle of −30 degrees or more and 0 degrees or less to a greater angle of 0 degrees or less.

The first blade angle β1 may include, in a range where the dimensionless position M is more than 0.7 and 1 or less, a range where the first blade angle gradually decreases as the dimensionless position M approaches the trailing edge 824 and the first blade angle is −30 degrees or more and 0 degrees or less. In other words, in at least part of the range where the dimensionless position M is more than 0.7 and 1 or less, the first blade angle β1 may have an angular distribution in which the angle gradually decreases as the dimensionless position M approaches the trailing edge 824 from an angle of −30 degrees or more and 0 degrees or less to a smaller angle of −30 degrees or more.

As a result, it is possible to suppress the circumferential stress acting on the cover 83 in response to deformation of the cover 83 due to centrifugal force while maintaining the performance of the impeller 8.

In the impeller 8 according to some embodiments, the blade angle difference Δβ may include, in a range where the dimensionless position M is 0 or more and less than 0.4, a range where the angle difference gradually increases as the dimensionless position M approaches the trailing edge 824 and the angle difference is 30 degrees or less. In other words, in at least part of the range where the dimensionless position M is 0 or more and less than 0.4, the blade angle difference Δβ may have a distribution in which the angle difference gradually increases as the dimensionless position M approaches the trailing edge 824 from an angle difference of 30 degrees or less to a greater angle difference of 30 degrees or less.

The blade angle difference Δβ may include, in a range where the dimensionless position M is 0.4 or more and 0.7 or less, a range where the angle difference gradually increases as the dimensionless position M approaches the maximum blade angle difference position Ma from the leading edge 823 side and the angle difference is 30 degrees or more and 40 degrees or less. In other words, in at least part of the range where the dimensionless position M is 0.4 or more and 0.7 or less, the blade angle difference Δβ may have a distribution in which the angle difference gradually increases as the dimensionless position M approaches the maximum blade angle difference position Ma from the leading edge 823 side from an angle difference of 30 degrees or more and 40 degrees or less to a greater angle difference of 40 degrees or less.

The blade angle difference Δβ may include, in a range where the dimensionless position M is 0.4 or more and 0.7 or less, a range where the angle difference gradually decreases as the dimensionless position M approaches the trailing edge 824 from the maximum blade angle difference position Ma and the angle difference is 30 degrees or more and 40 degrees or less. In other words, in at least part of the range where the dimensionless position M is 0.4 or more and 0.7 or less, the blade angle difference Δβ may have a distribution in which the angle difference gradually decreases as the dimensionless position M approaches the trailing edge 824 from the maximum blade angle difference position Ma from an angle difference of 30 degrees or more and 40 degrees or less to a smaller angle difference of 30 degrees or more.

The blade angle difference Δβ may include, in a range where the dimensionless position M is more than 0.7 and 1 or less, a range where the angle difference gradually decreases as the dimensionless position M approaches the trading edge 824 and the angle difference is 30 degrees or less. In other words, in at least part of the range where the dimensionless position M is more than 0.7 and 1 or less, the blade angle difference Δβ may have a distribution in which the angle difference gradually decreases as the dimensionless position M approaches the trailing edge 824 from an angle difference of 30 degrees or less to a smaller angle difference.

As a result, it is possible to suppress the circumferential stress acting on the cover 83 in response to deformation of the cover 83 due to centrifugal force while maintaining the performance of the impeller 8.

(Shape of Leading Edge 823)

For example as shown in FIG. 2, in the impeller 8 according to some embodiments, in a meridian plane of the blade 82, an angle difference Δθ between the radial direction and the extension direction of a line segment connecting the end portion 823*a* adjacent to the disc 81 and the end portion 823*b* adjacent to the cover 83 at the leading edge 823 may be 15 degrees or less. When the angle difference Δθ is 15 degrees or less, the end portion 823*a* adjacent to the disc 81 at the leading edge 823 may be located on the axially upstream side of the end portion 823*b* adjacent to the cover 83 at the leading edge 823, may be located on the downstream side, or may be located at the same position in the axial direction.

With this configuration, since the range where the blade 82 connects the disc 81 to the cover 83 can be enlarged to the axially upstream side, the stiffness of the cover 83 can be increased in the vicinity of the leading edge 823.

(Connection Member 90)

Figure 5:
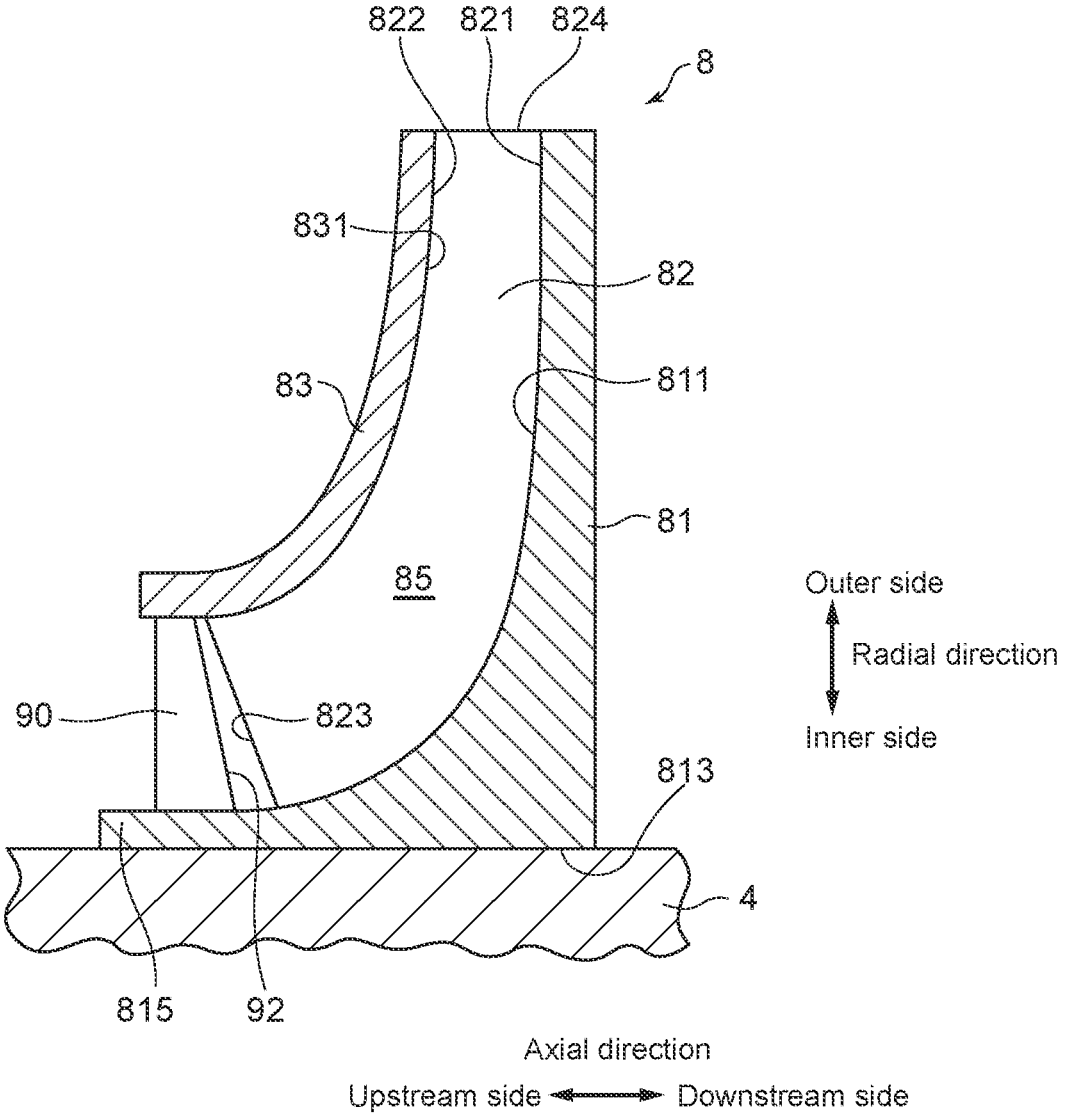
FIG. 5 is a diagram showing an example where a connection member is provided to the impeller according to some embodiments.

FIG. 5 is a diagram showing an example where a connection member 90 is provided to the impeller 8 according to some embodiments. As shown in FIG. 5, the impeller 8 according to some embodiments may include a connection member 90 disposed at least partially away from the leading edge 823 in the axial direction and connecting the disc 81 and the cover 83.

In the impeller 8 according to some embodiments, the connection member 90 may be a plate member disposed upstream of the leading edge 823 in the axial direction and having the same thickness as the thickness of the blade 82 in the vicinity of the leading edge 823.

In the impeller 8 according to sonic embodiments, an axially downstream end portion 92 of the connection member 90 may be separated from the leading edge 823 and may be at least partially connected to the leading edge 823. Specifically, the number of connection members 90 is preferably the same as the number of blades 82, but it may be different from the number of blades 82. Further, the connection member 90 is preferably disposed on a virtual curve extending the camber line CL of the blade 82 upstream in the axial direction, but it may be disposed away from the virtual curve in the circumferential direction.

In the impeller 8 according to some embodiments including the connection member 90, since the connection member 90 connects the disc 81 and the cover 83, the stiffness of the cover 83 can be increased in the vicinity of the leading edge 823.

(Thickness of Axially Upstream Portion of Disc 81 in Radial Direction)

Figure 6:
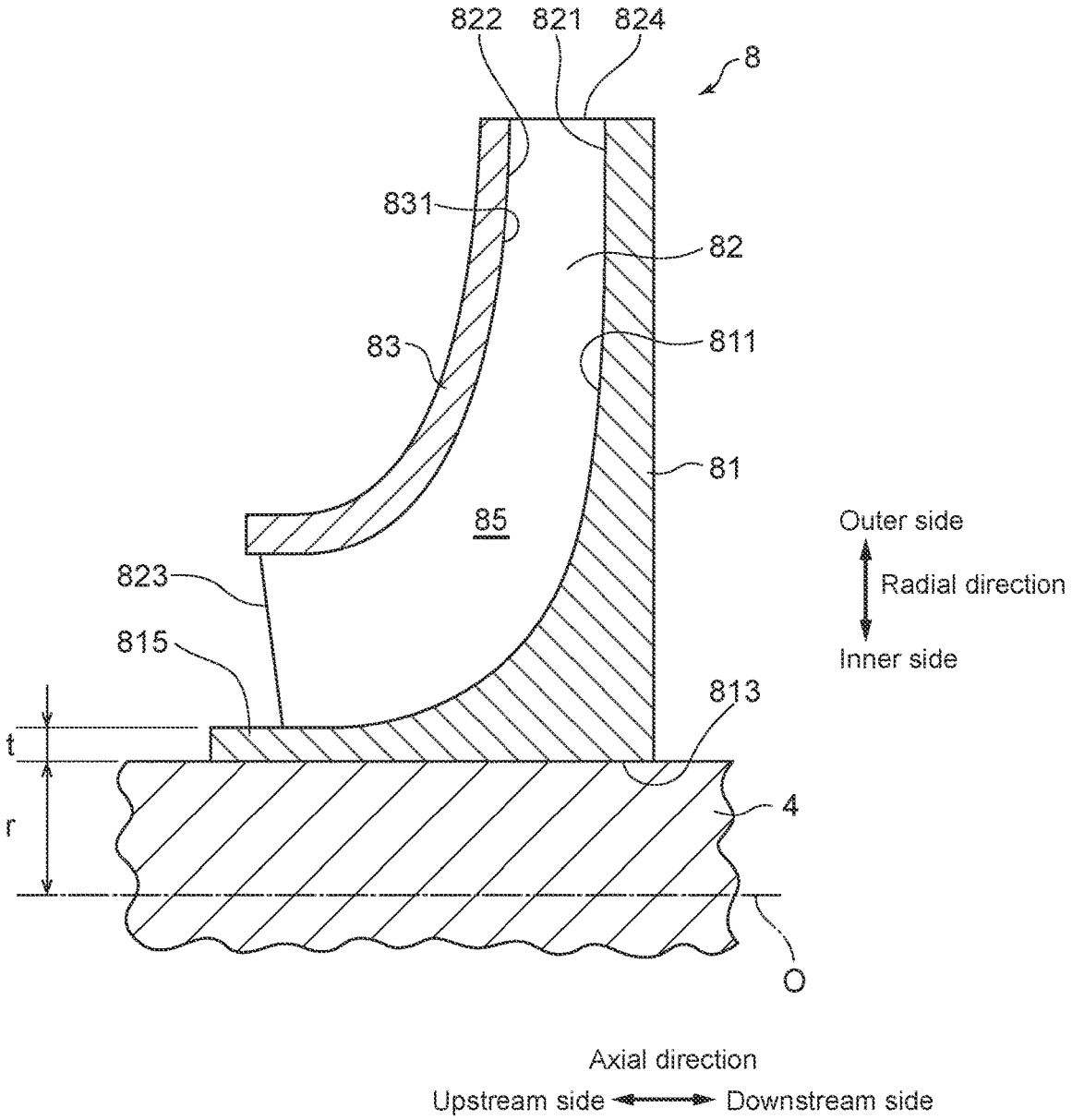
FIG. 6 is a diagram for describing the thickness in the radial direction of the axially upstream portion of the disc of the impeller according to some embodiments.

FIG. 6 is a diagram for describing the thickness in the radial direction of the axially upstream portion of the disc 81 of the impeller 8 according to some embodiments.

As described above, in the impeller 8 according to sonic embodiments, the through hole 813 is formed in the radially inner portion of the disc 81 to penetrate the disc 81 in the axis O direction. In the impeller 8 according to some embodiments, the disc 81 has a cylindrical portion 815 surrounding the through hole 813 in the axially upstream region of the disc 81. In the impeller 8 according to some embodiments, as the thickness of the cylindrical portion 815, for example, the radius r of the through hole 813 may be 2 or more and 5 or less when the thickness t, along the radial direction, of the end portion of the disc 81 adjacent to the leading edge 823 in the axial direction is defined as 1. In a conventional impeller, when the thickness t of the impeller is defined as 1, the radius r of the impeller is generally 5 or more and 15 or less.

Thus, the thickness t, along the radial direction, of the end portion of the disc 81 adjacent to the leading edge 823 in the axial direction can be made larger than that of the conventional impeller, and the stiffness of the disc 81 against centrifugal force can be increased. As described above, the cover 83 is connected to the disc 81 via the blade 82. Accordingly, when the thickness and the radius r are set as described above, the deformation of the cover 83 due to centrifugal force can be suppressed.

As described above, in the impeller 8 according to some embodiments, it is possible to suppress the circumferential stress acting on the cover 83 in response to deformation of the cover 83 due to centrifugal force. In addition, with the centrifugal compressor 1 including the impeller 8 according to some embodiments, since the impeller 8 according to some embodiments is used, it is possible to increase the capacity of the centrifugal compressor 1 and reduce the dimension of the centrifugal compressor 1.

The present disclosure is not limited to the embodiments described above, but includes modifications to the embodiments described above, and embodiments composed of combinations of those embodiments.

For example, in the above-described embodiments, the impeller 8 is used in the multi-stage centrifugal compressor 1 as an example of the rotating machine. However, the impeller 8 according to some embodiments may be used in other types of rotating machines, such as a single-stage compressor, radial turbine, or a pump.

The contents described in the above embodiments would be understood as follows, for instance.

(1) An impeller 8 of a rotating machine according to at least one embodiment of the present disclosure comprises: a disc 81; a cover 83 disposed on the opposite side of a radial passage 85 from the disc 81 in the axial direction; and a blade 82 disposed between the disc 81 and the cover 83. In a dimensionless position M along a camber line CL of the blade 82 when the position of a leading edge 823 of the blade 82 is defined as 0 and the position of a trailing edge 824 of the blade 82 is defined as 1, a position (maximum blade angle difference position Ma) where an angle difference (blade angle difference Δβ) between a first blade angle at an end portion of the blade 82 adjacent to the disc 81 (disc-side end portion 821) and a second blade angle β2 at an end portion of the blade 82 adjacent to the cover 83 (cover-side end portion 822) is maximum is in a range of 0.5 or more and 1 or less. The first blade angle β1 is −10 degrees or more and 0 degrees or less at the position (maximum blade angle difference position Ma) where the angle difference (blade angle difference Δβ) is maximum.

With the impeller 8 according to the above configuration (1), as the blade angle difference Δβ increases, the blade 82 deforms in the thickness direction of the blade 82 so as to be twisted from a flat shape, and the three-dimensional shape becomes more complex, so that the stiffness of the blade 82 can be increased without increasing the thickness of the blade 82. As a result, it is possible to suppress the cover 83 from deforming due to centrifugal force while suppressing the increase in weight of the blade 82.

In the impeller 8 according to the above configuration (8), since the maximum blade angle difference position Ma is in the range of 0.5 or more and 1 or less, the stiffness of the blade 82 in the radially outer region can be increased. Thus, it is possible to effectively suppress the cover 83 from deforming due to centrifugal force which tends to increase on the radially outer side.

The closer the first blade angle β1 is to 0 degrees, the closer the extension direction of the blade 82 from the leading edge 823 to the trailing edge 824 is to the radial direction, and the greater the stiffness near the root of the blade 82, i.e., near the disc-side end portion 821, against bending of the blade 82 by the centrifugal force received from the cover 83. For this reason, the impeller 8 according to the above configuration (1) is configured such that the first blade angleβ1 is −10 degrees or more at the maximum blade angle difference position Ma. As a result, it is possible to effectively suppress the cover 83 from deforming due to centrifugal force which tends to increase on the radially outer side.

Further, when the first blade angle β1 is −10 degrees or more at the maximum blade angle difference position Ma, compared to a conventional impeller, the blade angle difference Δβ can be increased, and the stiffness of the blade 82 can be increased without increasing the thickness of the blade 82.

If one intends to simply increase the blade angle difference Δβ, by setting the first blade angle β1 to a positive value, the blade angle difference Δβ can be increased. However, in the impeller 8 according to the above configuration (1), an upper limit (0 degrees) is set for the first blade angle β1 from the viewpoint of maintaining the performance of the impeller 8.

With the above configuration (1), since the deformation of the cover 83 due to centrifugal force can be effectively suppressed, it is possible to suppress the circumferential stress acting on the cover 83 in response to deformation of the cover 83 due to centrifugal force. As a result, it is possible to contribute to a higher peripheral speed of the impeller 8 and contribute to a larger capacity and a smaller dimension of the centrifugal compressor 1.

(2) In some embodiments, in the above configuration (1), the dimensionless position Mb where a difference between the second blade angle β2 and an assumed angle Va when change in the second blade angle β2 over change in the dimensionless position M is assumed to be constant from the leading edge 823 to the trailing edge 824 is maximum may be in a range where the dimensionless position M is less than 0.5.

With the above configuration (2), compared to the case where the dimensionless position Mb, where the difference between the second blade angle β2 and the assumed angle Va is maximum, is in the range of 0.5 or more, it is easier to increase the blade angle difference Δβ and increase the stiffness of the blade 82.

(3) In some embodiments, in the above configuration (1) or (2), a value obtained by dividing a difference Δβ2*a* between the second blade angle β2 and an assumed angle Va when change in the second blade angle β2 over change in the dimensionless position M is assumed to be constant from the leading edge 823 to the trading edge 824 by a difference Δβ2*b* between the second blade angle β2-0 at the leading edge 823 and the assumed angle Va. may be 0.15 or less at the position (maximum blade angle difference position Ma) where the angle difference (blade angle difference Δβ) is maximum.

With the above configuration (3), the blade angle difference Δβ can be increased, and the stiffness of the blade 82 can be increased.

(4) In some embodiments, in any one of the above configurations (1) to (3), the second blade angle β2 may monotonically increase as the dimensionless position M approaches the trailing edge 824, on the trailing edge 824 side of the position (maximum blade angle difference position Ma) where the angle difference (blade angle difference Δβ) is maximum.

With the above configuration (4), since the second blade angle β2 at the maximum blade angle difference position Ma is smaller than the second blade angle β2 at the trailing edge 824, it is easier to increase the blade angle difference Δβ at the maximum blade angle difference position Ma and increase the stiffness of the blade 82.

(5) In some embodiments, in any one of the above configurations (1) to (4), the first blade angle β1 may monotonically decrease as the dimensionless position M approaches the trailing edge 824, on the trailing edge 824 side of the position (maximum blade angle difference position Ma) where the angle difference is maximum.

With the above configuration (5), since the first blade angle β1 at the maximum blade angle difference position Ma is greater than the first blade angle β1 at the trailing edge 824, it is easier to increase the blade angle difference Δβ at the maximum blade angle difference position Ma and increase the stiffness of the blade 82.

(6) In some embodiments, in any one of the above configurations (1) to (5), the first blade angle β1 may gradually increase from a value less than −30 degrees as the dimensionless position M approaches the trailing edge 824, on the leading edge 823 side of the position (maximum blade angle difference position Ma) where the angle difference is maximum.

With the above configuration (6), on the leading edge 823 side of the maximum blade angle difference position Ma, the first blade angle β1 can be made closer to the first blade angle β1 in a conventional impeller as it approaches the leading edge 823. As a result, it is possible to contribute to maintaining the performance of the impeller 8.

(7) in some embodiments, in any one of the above configurations (1) to (6), the angle difference (blade angle difference Δβ) may gradually increase from a value less than 30 degrees as the dimensionless position M approaches the trailing edge 824 in a range on the leading edge 823 side of the position (maximum blade angle difference position Ma) where the angle difference is maximum, and the angle difference may gradually decrease to a value less than 30 degrees as the dimensionless position M approaches the trailing edge 824 in a range on the trailing edge 824 side of the position where the angle difference is maximum.

With the above configuration (7), on the trailing edge 824 side of the maximum blade angle difference position Ma, the first blade angle β1 can be made closer to the first blade angle β1 in a conventional impeller as it approaches the trailing edge 824. As a result, it is possible to contribute to maintaining the performance of the impeller 8.

(8) In some embodiments, in any one of the above configurations (1) to (7), the first blade angle β1 may include, in a range where the dimensionless position M is 0 or more and less than 0.4, a range where the first blade angle gradually increases as the dimensionless position M approaches the trailing edge 824 and the first blade angle is −50 degrees or more and −30 degrees or less. The first blade angle β1 may include, in a range where the dimensionless position M is 0.4 or more and 0.7 or less, a range where the first blade angle gradually increases as the dimensionless position M approaches the trailing edge 824 and the first blade angle is 30 degrees or more and 0 degrees or less. The first blade angle β1 may include, in a range where the dimensionless position M is more than 0.7 and 1 or less, a range where the first blade angle gradually decreases as the dimensionless position M approaches the trailing edge 824 and the first blade angle is −30 degrees or more and 0 degrees or less.

With the above configuration (8), it is possible to suppress the circumferential stress acting on the cover 83 in response to deformation of the cover 83 due to centrifugal force while maintaining the performance of the impeller 8.

(9) In some embodiments, in any one of the above configurations (1) to (8), the angle difference (blade angle difference Δβ) may include, in a range where the dimensionless position M is 0 or more and less than 0.4, a range where the angle difference gradually increases as the dimensionless position M approaches the trailing edge 824 and the angle difference is 30 degrees or less. The angle difference (blade angle difference Δβ) may include, in a range where the dimensionless position M is 0.4 or more and 0.7 or less, a range where the angle difference gradually increases as the dimensionless position M approaches the position (maximum blade angle difference position Ma) where the angle difference is maximum from the leading edge 823 side and the angle difference is 30 degrees or more and 40 degrees or less. The angle difference (blade angle difference Δβ) may include, in a range where the dimensionless position M is 0.4 or more and 0.7 or less, a range where the angle difference gradually decreases as the dimensionless position M approaches the trailing edge 824 from the position (maximum blade angle difference position Ma) where the angle difference is maximum and the angle difference is 30 degrees or more and 40 degrees or less. The angle difference (blade angle difference Δβ) may include, in a range where the dimensionless position M is more than 0.7 and 1 or less, a range where the angle difference gradually decreases as the dimensionless position M approaches the trailing edge 824 and the angle difference is 30 degrees or less.

With the above configuration (9), it is possible to suppress the circumferential stress acting on the cover 83 in response to deformation of the cover 83 due to centrifugal force while maintaining the performance of the impeller 8.

(10) In some embodiments, in any one of the above configurations (1) to (9), in a meridian plane of the blade 82, an angle difference Δθ between the radial direction and the extension direction of a line segment connecting the end portion 823*a* adjacent to the disc 81 and the end portion 823*b* adjacent to the cover 83 at the leading edge 823 may be 15 degrees or less.

With the above configuration (10), since the range where the blade 82 connects the disc 81 to the cover 83 can be enlarged to the leading edge 823 side (axially upstream side), the stiffness of the cover 83 can be increased in the vicinity of the leading edge 823.

(11) In some embodiments, in any one of the above configurations (1) to (10), the impeller may further comprise a connection member 90 disposed at least partially away from the leading edge 823 in the axial direction and connecting the disc 81 and the cover 83.

With the above configuration (11), since the connection member 90 connects the disc 81 and the cover 83, the stiffness of the cover 83 can be increased in the vicinity of the leading edge 823.

(12) In some embodiments, in any one of the above configurations (1) to (11), the disc 81 has a through hole 813 extending in the axial direction. The radius r of the through hole 813 may be 2 or more and 5 or less when the thickness t, along the radial direction, of the end portion of the disc 81 adjacent to the leading edge 823 in the axial direction is defined as 1.

With the above configuration (12), the thickness t, along the radial direction, of the end portion of the disc 81 adjacent to the leading edge 823 in the axial direction can be made larger than that of the conventional impeller, and the stiffness of the disc 81 against centrifugal force can be increased. As described above, the cover 83 is connected to the disc 81 via the blade 82. Accordingly, with the above configuration (12), the deformation of the cover 83 due to centrifugal force can be suppressed.

(13) A rotating machine according to at least one embodiment of the present disclosure comprises the impeller having any one of the above configurations (1) to (12).

With the above configuration (13), it is possible to contribute to a larger capacity and a smaller dimension of the rotating machine.

The invention claimed is:

1. An impeller of a rotating machine, the impeller comprising:

a disc;

a cover disposed on an opposite side of a radial passage from the disc in an axial direction; and a blade disposed between the disc and the cover, wherein, in a dimensionless position along a camber line of the blade when the position of a leading edge of the blade is defined as 0 and the position of a trailing edge of the blade is defined as 1, a position where an angle difference between a first blade angle at a disc-side end portion of the blade and a second blade angle at a cover-side end portion of the blade is maximum is in a range of 0.5 or more and 1 or less, and wherein the first blade angle is −10 degrees or more and 0 degrees or less at the position where the angle difference is maximum.

2. The impeller of the rotating machine according to claim 1, wherein the dimensionless position where a difference between the second blade angle and an assumed angle when change in the second blade angle over change in the dimensionless position is assumed to be constant from the leading edge to the trailing edge is maximum is in a range where the dimensionless position is less than 0.5.

3. The impeller of the rotating machine according to claim 1, wherein a value obtained by dividing a difference between the second blade angle and an assumed angle when change in the second blade angle over change in the dimensionless position is assumed to be constant from the leading edge to the trailing edge by a difference between the second blade angle at the leading edge and the assumed angle is 0.15 or less at the position where the angle difference is maximum.

4. The impeller of the rotating machine according to claim 1, wherein the second blade angle monotonically increases as the dimensionless position approaches the trailing edge, on the trailing edge side of the position where the angle difference is maximum.

5. The impeller of the rotating machine according to claim 1, wherein the first blade angle monotonically decreases as the dimensionless position approaches the trailing edge, on the trailing edge side of the position where the angle difference is maximum.

6. The impeller of the rotating machine according to claim 1, wherein the first blade angle gradually increases from a value less than −30 degrees as the dimensionless position approaches the trailing edge, on the leading edge side of the position where the angle difference is maximum.

7. The impeller of the rotating machine according to claim 1, wherein the angle difference gradually increases from a value less than 30 degrees as the dimensionless position approaches the trailing edge in a range on the leading edge side of the position where the angle difference is maximum, and the angle difference gradually decreases to a value less than 30 degrees as the dimensionless position approaches the trailing edge in a range on the trailing edge side of the position where the angle difference is maximum.

8. The impeller of the rotating machine according to claim 1, wherein the first blade angle includes, in a range where the dimensionless position is 0 or more and less than 0.4, a range where the first blade angle gradually increases as the dimensionless position approaches the trailing edge and the first blade angle is −50 degrees or more and −30 degrees or less, in a range where the dimensionless position is 0.4 or more and 0.7 or less, a range where the first blade angle gradually increases as the dimensionless position approaches the trailing edge and the first blade angle is −30 degrees or more and 0 degrees or less, and in a range where the dimensionless position is more than 0.7 and 1 or less, a range where the first blade angle gradually decreases as the dimensionless position approaches the trailing edge and the first blade angle is −30 degrees or more and 0 degrees or less.

9. The impeller of the rotating machine according to claim 1, wherein, the angle difference includes, in a range where the dimensionless position is 0 or more and less than 0.4, a range where the angle difference gradually increases as the dimensionless position approaches the trailing edge and the angle difference is 30 degrees or less, in a range where the dimensionless position is 0.4 or more and 0.7 or less, a range where the angle difference gradually increases as the dimensionless position approaches the position where the angle difference is maximum from the leading edge side and the angle difference is 30 degrees or more and 40 degrees or less, in a range Where the dimensionless position is 0.4 or more and 0.7 or less, a range where the angle difference gradually decreases as the dimensionless position approaches the trailing edge from the position where the angle difference is maximum and the angle difference is 30 degrees or more and 40 degrees or less, and in a range where the dimensionless position is more than 0.7 and 1 or less, a range where the angle difference gradually decreases as the dimensionless position approaches the trailing edge and the angle difference is 30 degrees or less.

10. The impeller of the rotating machine according to claim 1, wherein, in a meridian plane of the blade, an angle difference between a radial direction and an extension direction of a line segment connecting the disc-side end portion and the cover-side end portion at the leading edge is 15 degrees or less.

11. The impeller of the rotating machine according to claim 1, further comprising a connection member disposed at least partially away from the leading edge in the axial direction and connecting the disc and the cover.

12. The impeller of the rotating machine according to claim 1, wherein the disc has a through hole extending in the axial direction, and wherein a radius of the through hole is 2 or more and 5 or less when a thickness, along a radial direction, of a leading-edge-side end portion of the disc in the axial direction is defined as 1.

13. A rotating machine, comprising the impeller according to claim 1.

* * * * *